US005897063A

United States Patent [19]

Patzelt et al.

[11] Patent Number: 5,897,063

[45] Date of Patent: Apr. 27, 1999

[54] METHOD OF COMMINUTING ORE MATERIAL

[75] Inventors: Norbert Patzelt, Beckum; Johann Knecht, Wadersloh, both of Germany

[73] Assignee: Krupp Polysius AG, Beckum, Germany

[21] Appl. No.: 08/906,071

[22] Filed: Aug. 5, 1997

Related U.S. Application Data

[63] Continuation of application No. 08/618,365, Mar. 19, 1996, abandoned.

[30] Foreign Application Priority Data

Apr. 4, 1995 [DE] Germany ..... 195 12 509

[51] Int. Cl.[6] ..... B02C 21/00

[52] U.S. Cl. ..... 241/24.1; 241/29; 241/80; 241/152.2

[58] Field of Search ..... 241/97, 80, 152.2, 241/29, 24.1, 24.12, 76, 78

[56] References Cited

U.S. PATENT DOCUMENTS

| | | | |
|---|---|---|---|
| 2,877,954 | 3/1959 | Myers | 241/29 X |
| 3,078,050 | 2/1963 | Hardinge | 241/29 X |
| 5,005,770 | 4/1991 | Suessegger | 241/29 X |
| 5,154,362 | 10/1992 | Knobloch et al. | 241/20 X |
| 5,462,234 | 10/1995 | Patzelt et al. | 241/29 X |

FOREIGN PATENT DOCUMENTS 3711926 10/1988 Germany .

*Primary Examiner*—Mark Rosenbaum

*Attorney, Agent, or Firm*—Reising, Ethington, Barnes, Kisselle, Learman & McCulloch, P.C.

[57] ABSTRACT

In this method of comminution according to the invention, pre-comminuted ore material is subjected to material bed comminution in a material bed roll mill. In order to achieve optimal comminution even of very different ore materials with a high throughput the ore material is pre-comminuted in an autogenous mill, whereupon at least fractions of fine material are separated out of the pre-comminuted material before the rest of the material is further comminuted in the material bed comminution.

14 Claims, 2 Drawing Sheets

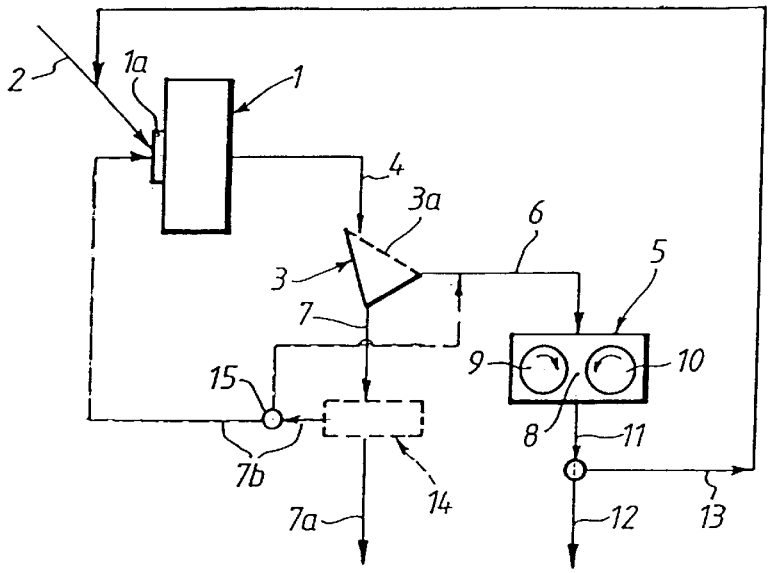
FIG.1
FIG.2
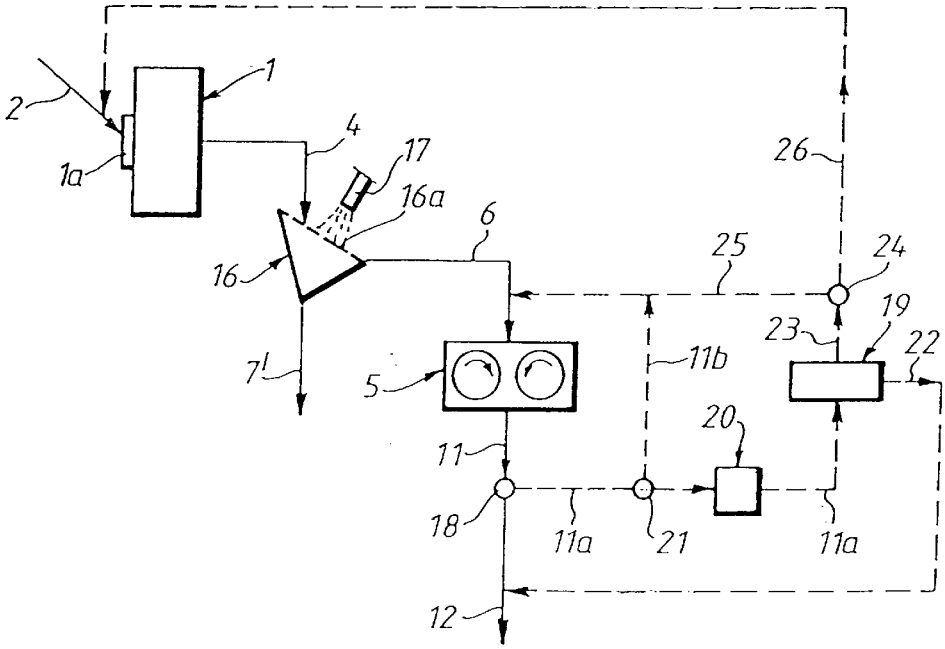

METHOD OF COMMINUTING ORE MATERIAL

This application is a continuation of application Ser. No. 08/618,365 filed on Mar. 19, 1996, now abandoned.

The invention relates to a method of comminuting ore material, in which pre-comminuted ore material is subjected to material bed comminution in a material bed roll mill.

BACKGROUND OF THE INVENTION

For the extraction of ore from ore material, freshly supplied ore material must be prepared in several process stages, the first stages of the preparation process including a suitable comminution of the fresh ore material supplied from a mine. For this purpose various methods, apparatus and comminution arrangements are known in the art. For instance, much use has been made recently of so-called material bed comminution in material bed roll mill, in which ore material pre-comminuted in a preceding crusher, e.g. a gyratory crusher or roll crusher, is further comminuted or finely comminuted in the grinding gap between two rolls which are pressed against one another with relatively high pressure and are driven so as to revolve in opposite directions. In this material bed comminution the pre-comminuted ore material is finely comminuted very thoroughly with a relative saving of energy, and the comminuted product coming from this material bed comminution or the corresponding material bed roll mill is obtained at least partially in the form of agglomerates, so-called scabs, which if required can be disagglomerated with the aid of simple equipment. The sufficiently finely comminuted ore material can be be separated off, optionally with the aid of a suitable screening or classifying arrangement, and drawn off as finished material or delivered to the subsequent stage of the preparation process, whilst any ore material which is not sufficiently comminuted is delivered for further comminution.

Brittle materials above all can be comminuted very effectively and with a saving of energy in material bed roll mills. In practical use, however, it has frequently proved to be a disadvantage that the throughput of the material bed roll mill is greatly reduced if the ore material to be comminuted contains components which are particularly fine, plastic, sticky or the like, as is the case for example with argillaceous fresh ore materials.

In other known methods and apparatus so-called autogenous mills are used for the comminution of the fresh ore material which may have been pre-crushed. In this comminution in an autogenous mill a certain proportion of the comminuted material can optionally be recirculated. In this case there are also constructions in which there is arranged after an autogenous mill at least one drum mill or agitator mill in which the comminuted product obtained in the autogenous mill is then reground to the desired fineness of the finished product. These mills can also be interconnected with a classifier so that the ore material is comminuted in a closed circuit and sufficiently fine material is drawn off from the classifier as finished material. An autogenous mill is a type of drum mill of relatively large diameter in which the pieces of material simultaneously form the grinding elements but in which in the case of certain materials a limited proportion of additional grinding elements in the form of grinding balls or the like can be added (in the latter case these are referred to as semi-autogenous mills).

A disadvantage of these autogenous mills described above is that their grinding efficiency is relatively low and therefore very large amounts of energy have to be expended for the comminution work to be carried out. Furthermore, in such an autogenous mill certain materials tend to form critical grain sizes which are only reduced to a small extent and thus by remaining in the mill lead to a considerable reduction in the throughput, often associated with an additionally increased energy consumption. The occurrence of critical grain sizes or grain fractions is in many cases attributable to ore materials consisting of components of differing grindability.

The object of the invention is to create a method of comminution by means of which, even in the case of ore material compositions consisting of differing components and even with undesired fine material fractions, plastic fractions, sticky fractions or the like in the ore material (starting ore material), an optimal comminution of these ore materials can be achieved with a relatively high throughput.

SUMMARY OF THE INVENTION

The procedure according to this method according to the invention is such that the ore material, particularly the fresh starting ore material, is pre-comminuted in an autogenous mill and then in a subsequent classification fine material fractions at least and preferably also other material fractions which hinder the comminution in a material bed roll mill are separated off, whilst the remaining ore material, which is generally of larger size, is delivered from this classification to the material bed comminution.

It should also be pointed out at this point that the autogenous mill can be both a mill which operates completely autogenously, that is to say a mill which operates without additional grinding elements such as grinding balls or the like, and also a semi-autogenous mill into which a limited proportion of grinding balls or other grinding elements can be put, for example approximately 33 to 15% of the filling of the grinding compartment (depending upon the properties of the material to be comminuted).

It has been shown that in such an autogenous mill the fresh ore material can be pre-comminuted with a relatively high throughput even if it includes a more or less large fraction having difficult handling properties, e.g. undesired fractions of very fine material, extremely plastic and/or sticky fractions (such as for instance in the case of argillaceous ore materials), relatively large and widely differing lump size as well as other contaminants. In the event of critical grain sizes occurring (as explained above) these can be drawn off simultaneously from the autogenous mill with the sufficiently pre-comminuted ore material using means which are known per se. In the subsequent classification provision is made to ensure that the fractions which hinder the material bed comminution in the material bed roll mill, i.e. at least the fractions of fine or very fine material, but also sticky and plastic fractions, are separated out from the pre-comminuted material. Thus only the remaining material which is freed from these undesired fractions which hinder the comminution in the material bed roll mill are delivered to the material bed comminution, and in this case, above all due to the pre-comminution of the starting ore material in a semi-autogenous mill, a feed grain size can be achieved which is particularly favourable for further comminution in a material bed roll mill, so that an optimal material bed comminution with a high throughput can be ensured. Thus this method according to the invention optimises the comminution of ore material by a rational co-ordination or co-operation of the autogenous mill for the pre-comminution of the ore material, subsequent classification for abstraction of the material fractions which hinder the material bed comminution and the material bed roll mill for efficient and energy-saving material bed comminution. With this method according to the invention an apparatus for carrying it out can also be installed in a particularly space-saving manner which, in the case of the aforementioned co-ordination of the autogenous mill, classification or classifier and material bed roll mill, is attributable above all to the compact construction of this material bed roll mill.

The classification of the pre-comminuted ore material (between the autogenous mill and material bed roll mill) can be carried out—as will be explained in greater detail below with reference to examples—either dry, i.e. without the addition of a fluid, or in the form of a wet classification in a screening device, and in the latter case fine material as well as any plastic, sticky and/or other material fractions which may be present are washed out of the pre-comminuted ore material sliding over a screen by the spraying on of fluid, particularly water, and are drawn off as screenings. The remaining ore material, that is to say in particular the oversize fractions, is then subjected to the material bed comminution. Likewise it is possible to carry out classification in a cyclone stage, in which case the lower cyclone discharge product is freed of adhered fine material in a subsequent screening device by the spraying on of water—as described above.

In particular the fine material obtained in the classification, but possibly also the other material fractions drawn off with it, can then be delivered directly to a further stage of the preparation process. However, if required the fine material from the classification can also be finely comminuted or finely ground in at least one fine grinding mill, e.g. a drum mill or agitator mill, to a predetermined product fineness.

According to this method according to the invention it may also be advantageous if a) the fine material obtained in the classification is divided in a secondary classification into finished material to be drawn off and larger fine material, this larger fine material then being led back in an adjustable manner to the autogenous mill and/or delivered to the material bed roll mill;

b) the comminuted product obtained in the material bed comminution is recirculated—at least partially or in total—to the autogenous mill.

In the latter case it is also possible for at least an adjustable proportion of the comminuted product obtained in the material bed comminution likewise to be delivered to the secondary classification—as set out under a).

According to another advantageous embodiment of this method according to the invention at least an adjustable proportion of the comminuted product obtained in the material bed comminution can be drawn off and recirculated to the material bed roll mill and/or to the autogenous mill. This results in the first place in a higher degree of comminution and in the second place in a better utilisation of capacity on the one hand of the material bed roll mill and on the other hand of the autogenous mill.

With this procedure last explained above it may also be particularly advantageous for optimal utilisation of the capacity of the material bed roll mill and for a particularly effective capacity of the rolls disposed therein for drawing in material if a further adjustable proportion of the comminuted product which is drawn off is recirculated directly to the material bed roll mill.

With this procedure it may also be particularly advantageous for at least the greater part of the comminuted product which is drawn off to be delivered to a classifying device, in which case it may also be preferable if the comminuted product to be delivered to this device has been previously disagglomerated in a suitable manner. Fine material obtained in the classification device is then advantageously by choice either drawn off from the device as finished product or is brought together with the other comminuted product from the material bed comminution (that is to say with the fraction of this comminuted product which has not been drawn off), or also adjustable fractions of this fine material can on the one hand be drawn off as finished product and on the other hand brought together with the other comminuted product. In the meantime the oversize material obtained in the classification device is recirculated in an adjustable manner to the material bed roll mill and/or to the autogenous mill, and this can be easily adapted to the particular requirements in the material bed roll mill and in the autogenous mill. Above all in the case of fresh ore material in particularly large lumps it may from time to time be advantageous for this material first of all to be pre-crushed in a primary crusher (e.g. gyratory crusher or the like) before being fed into the autogenous mill.

THE DRAWINGS

These and further details of the invention are revealed by the following description of some embodiments of apparatus which are illustrated in the drawings and are particularly suitable for carrying out the method according to the invention. In FIGS. 1 to 4 the various examples of the apparatus are illustrated largely in block diagram form, and in all Figures parts of the apparatus which are the same or similar are provided with the same reference numerals in order essentially to avoid explaining these parts several times.

DETAILED DESCRIPTION

Figure 3:
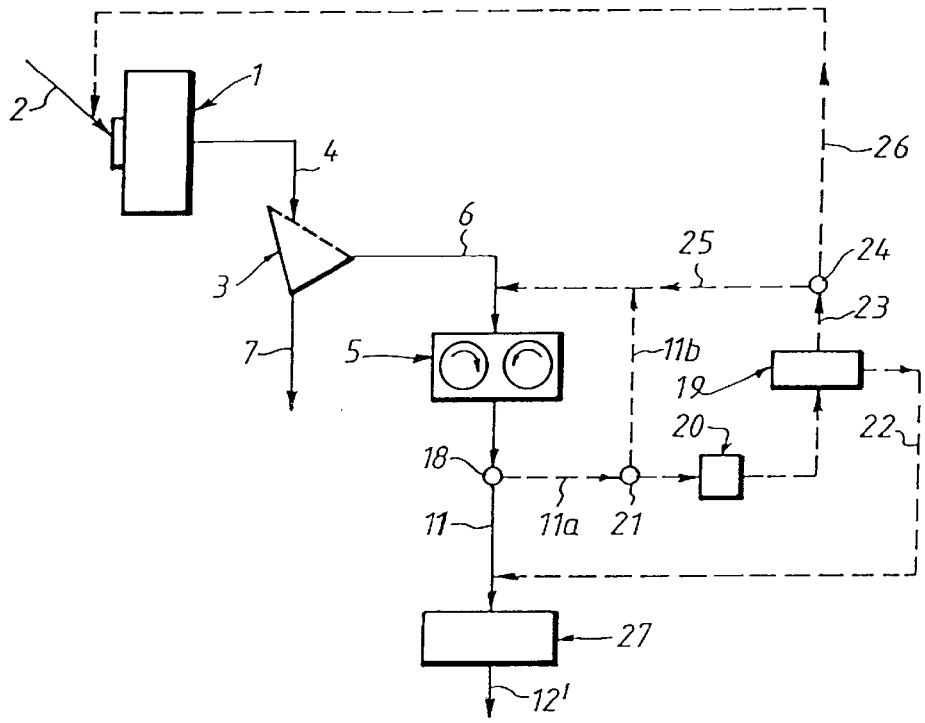

In the first embodiment which is illustrated in FIG. 1 of apparatus for carrying out the method of comminution according to the invention, in the basic construction an autogenous mill 1 for pre-comminution of fresh ore material (arrow 2), a classifier 3 following the autogenous mill 1 for dividing the pre-comminuted ore material (arrow 4) as well as a material bed roll mill 5 for comminution (main comminution) of the oversize material (arrow 6) obtained in the classifier 3 are connected together or connected one behind the other in a suitable manner.

The autogenous mill 1 may—as already explained above—be both an autogenous mill operating completely autogenously, i.e. without additional grinding elements (e.g. grinding balls) and a semi-autogenous mill in which a limited proportion of additional grinding elements, e.g. grinding balls, is contained.

The classifier 3 may basically be a screening device which is known per se or also a cyclone stage. In FIG. 1 it may be assumed that the classifier 3 takes the form of a screening device with an upper screen deck 3*a* to which the pre-comminuted ore material (arrow 4) is delivered from above in order—in this example—to carry out a dry classification of the pre-comminuted ore material. In this classification the pre-comminuted ore material 4 is divided into oversize material according to the arrow 6 and fine material according to the arrow 7, the oversize material 6 representing the screen residue on the screen deck 3*a* and the fine material 7 the screenings.

In the material bed roll mill 5 the oversize material 6 obtained in the classifier 3 from the pre-comminuted material 4 is subjected to material bed comminution which is known per se, being further comminuted in the material bed roll mill in the grinding gap 8 between two rolls 9, 10 which are pressed against one another with relatively high pressure and are driven so that they revolve in opposite directions.

In the previously described construction of the embodiment of the apparatus according to FIG. 1 the comminution of the fresh ore material 2 can be carried out in the following manner: The fresh ore material 2 is sufficiently pre-comminuted in the autogenous mill 1 and then delivered as pre-comminuted ore material 4 to the subsequent classification in the classifier 3. In the classification which in this case (FIG. 1) is to be carried out dry, i.e. without the addition of fluid, the screen deck 3*a* is advantageously chosen with a mesh width such that above all fine material fractions which could hinder the material bed comminution in the material bed roll mill 5 are separated out of the pre-comminuted ore material 4. Accordingly a division of the pre-comminuted ore material 4 into oversize material 6 and fine material 7 takes place in the classifier 3. The comminuted product according to the arrow 11 which is obtained in the material bed comminution in the material bed roll mill 5 can, depending upon the subsequent stage of the preparation process, either likewise be drawn off as finished product (according to the arrow 12) or it can be at least partially or completely recirculated according to the arrow or line 13 to the inlet connection 1*a* of the autogenous mill 1.

FIG. 1 also shows in broken lines how the previously described embodiment of the apparatus or method can be further developed. Accordingly the fine material 7 obtained in the classifier 3 can be subjected to secondary classification in a suitable secondary classifier 14 in which the fine material 7 is divided into finished product 7*a* to be drawn off and large fine material or intermediate material 7*b*. This larger fine material or intermediate material 7*b* can then, with the aid of a suitable adjusting flap 15 or the like, be by choice either all recirculated to the autogenous mill 1 or delivered to the material bed roll mill 5 or in adjustable fractions some can be recirculated to the autogenous mill 1 and the rest delivered to the material bed roll mill 5. In this way an optimal utilisation of the two mills 1 and 5 can be achieved.

FIG. 2 shows an example of apparatus which differs in many respects from the example according to FIG. 1. First of all in the region between the autogenous mill 1 and the material bed roll mill 5 for the classification of the pre-comminuted ore material 4 a wet classifier 16 is provided in the form of a screening device which has an upper screen deck 16*a* above which a suitable water spraying arrangement 17 is disposed. In this wet classifier 16 a wet classification can be carried out in such a way that fractions of very fine material or fine material as well as any plastic and/or sticky material fractions which may be present are washed out of the pre-comminuted ore material sliding over a screen with the aid of the water spraying arrangement, that is to say by the spraying on of water, and are then drawn off as screenings according to the arrow 7'. Accordingly the material fractions which would hinder material bed comminution in the material bed roll mill 5 can above all be very effectively separated out of the pre-comminuted ore material 4 with the aid of the wet classifier 16.

Furthermore, the example according to FIG. 2 provides several possible choices for passing on the comminuted product 11 obtained in the material bed comminution in the material bed roll mill 5 at least partially in the form of agglomerates, particularly so-called scabs. Below the material bed roll mill 5 there is advantageously disposed a suitable adjusting flap 18 with which an adjustable fraction 11*a*, but, if required, the totality of the comminuted product 11 can be led off out of the material bed roll mill 5. The remaining fraction of comminuted product, but, if required, also the totality of the comminuted product 11, can—in a similar manner to FIG. 1—be drawn off as finished product according to the arrow 12 and optionally delivered to a further stage in the preparation process.

As is illustrated by the broken lines of arrows in FIG. 2, by choice the greater part or also the entire fraction of the comminuted product 11*a* which is led off can be delivered to a classifier 19. In general it will be advantageous for this comminuted product 11*a* which has been led off first of all to be broken up or disagglomerated in a suitable disagglomerating arrangement 20 (as is known per se). It may often be advantageous if a further adjustable fraction 11*b* of the comminuted product which has been led off from the material bed comminution but not yet disagglomerated is recirculated directly to the material bed roll mill 5 with the aid of a further adjusting flap 21. In general a screening device, a screw classifier or the like is used here as the comminuting arrangement 19, because these types of classifiers are particularly well suited to moist ore material.

The classifier 19 serves for dividing up or classifying the abstracted fraction of comminuted product 11*a* into fine material according to the arrow 22 and oversize material according to the arrow 23. In the example according to FIG. 2 the fine material 22 is brought together with the rest of the comminuted product from the material bed comminution and drawn off jointly therewith as finished product 12. The oversize material 23 from the classifier 19, on the other hand, can in each case be recirculated by choice, with the aid of a further adjusting flap 24, either in its entirety or in adjustable fractions to the material bed roll mill 5 according to the arrow 25 and/or to the inlet connection 1*a* of the autogenous mill 1 according to the arrow 26. These guiding and switching possibilities for the various fractions of comminuted product from the material bed comminution offer ideal preconditions for creating optimal comminuting conditions both in the material bed roll mill 5 and in the autogenous mill 1.

Another example of apparatus is illustrated in FIG. 3; it differs from the one explained above (FIG. 2) principally by two variants or further developments. In the first place, for the classification of the pre-comminuted ore material 4 coming from the autogenous mill 1 a similar classification is carried out to that used in the example according to FIG. 1 in a classifier 3, particularly a corresponding screening device, in which the pre-comminuted ore material 4 is divided into fine material 7 to be drawn off as finished product and oversize material 6, which is subsequently subjected to material bed comminution in the material bed roll mill 5.

As a second variant of this embodiment (FIG. 3) by comparison with that of FIG. 2, the rest of the comminuted product 11 from the material bed comminution which has not been recirculated is not yet drawn off as finished product but is first of all reground in a fine grinding stage 27 to a predetermined fineness of the finished product; only thereafter is it drawn off as finished product 12'. As can be seen in FIG. 3, the rest of the comminuted product 11 from the material bed comminution which has not been recirculated is advantageously delivered together with the fine material 22 from the classifier 19 to the fine grinding stage 27. An appropriately adapted drum mill or agitator mill can be used as the fine grinding stage 27.

It should also be mentioned at this point that, if required, the fine material 7 or 7' respectively from the classifier 3 or 16 respectively can likewise be finely comminuted in at least one fine grinding mill (drum mill or agitator mill) to a predetermined product fineness, which in certain circumstances—if the products match—could even likewise take place in the fine grinding stage 27 according to FIG. 3.

Figure 4:
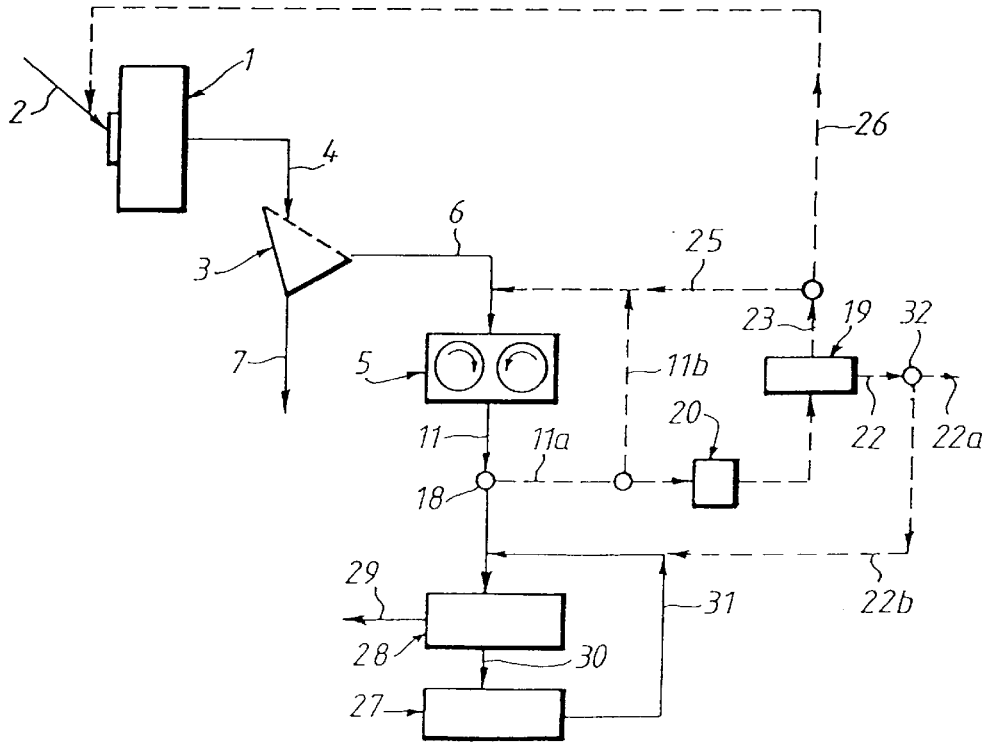

The embodiment according to FIG. 4 represents a further development of the example of apparatus previously explained with reference to FIG. 3.

According to FIG. 4 at least the rest of the comminuted product 11 from the material bed comminution which has not been recirculated to the material bed roll mill 5 or to the autogenous mill 1 is not delivered directly to the fine grinding stage 27 but to a further classifier 28 which in particular is formed by a screening device or the like and is disposed before the the fine grinding stage 27. From this further classifier 28 the fine material is drawn off as finished product according to the arrow 29, whilst only the oversize material is delivered according to the arrow 30 to the fine grinding stage 27. The finely ground product from this fine grinding stage 27 is returned to the classifier 28 according to the arrow 31.

In a further construction following the example according to FIG. 4, by choice, with the aid of a further adjusting flap 32, all of the fine material 22 coming from the separator 19 or adjustable fractions thereof is drawn off directly as finished product according to the arrow 22*a* and/or together with the finely ground product (arrow 31) and the rest of the product 11 from the material bed comminution which has not been recirculated is delivered to the further classifier 28 according to the arrow 22*b*.

The examples of apparatus which have been explained above with reference to FIGS. 1 to 4 make it clear that the method of comminution according to the invention can be adapted in an optimal manner to the conduct of the method and type of comminution which are most suitable in each case for very differing fresh ore materials, both for ore materials coming freshly from a mine and also for ore materials or mixtures of ores composed of a plurality of initial components. In this case, a corresponding relief of the load on the subsequent mills or classifiers can be created by drawing off fractions of ore materials which are already sufficiently finely comminuted, so that these apparatus parts can then be designed for correspondingly lower throughputs and thus can operate more economically.

We claim:

1. A method of comminuting fresh ore material comprising the steps of:

pre-comminuting the material in an autogenous mill;

separating the pre-comminuted material into relatively coarser and relatively finer fractions, the separation of the pre-comminuted material being carried out in a screening device by passing the material over a screen while treating the material with a spray of liquid in order to wash out as screenings the relatively finer fraction and any plastic and sticky material fractions from the remainder of the pre-comminuted material;

delivering the relatively coarser fraction of the pre-comminuted material to a material bed roll mill and further comminuting such material in a grinding gap between two rolls of the roll mill; and separating the further comminuted material into relatively fine and relatively coarse fractions.

2. The method of claim 1 wherein separation of the pre-comminuted material is carried out in a screening device by passing the material over a screen while treating the material with a spray of liquid in order to wash out as screenings the relatively finer fraction and any plastic and sticky material fractions from the remainder of the pre-comminuted material which is passed on to the material bed mill.

3. The method of claim 1 wherein the relatively finer fraction of the pre-comminuted material is delivered to a further preparation stage.

4. The method of claim 3 wherein at the further preparation stage the relatively finer fraction of the pre-comminuted material is further comminuted to a predetermined fineness.

5. The method of claim 1 wherein a) the separated relatively finer fraction of the pre-comminuted material is further divided in a secondary separation stage into a finished material fraction of predetermined fineness and a relatively larger material fraction which is delivered to a selected one of the autogenous mill and material bed roll mill; and b) the comminuted material of the material bed roll mill is selectively recirculated to the autogenous mill for further processing.

6. The method of claim 1 wherein at least a fraction of the comminuted material of the material roll bed is drawn off and recirculated to a selected one of the following stages consisting essentially of a) the material bed roll mill, b) the autogenous mill, and c) both the material bed roll mill and the autogenous mill.

7. The method of claim 6 wherein a further fraction of the comminuted material of the material bed roll mill is drawn off and recirculated directly to the material bed roll mill.

8. The method of claim 6 wherein a greater part of the fraction of comminuted material drawn off at the material bed roll mill is disagglomerated and then delivered to a classifier to separate a fraction of fine disagglomerated material from a remaining coarser fraction, and selectively combining the fine disagglomerated fraction with the other part of the comminuted material from the material bed roll mill and recirculating the remaining coarse fraction from the classifier to a selected one of the following locations consisting essentially of: a) the material bed roll mill, b) the autogenous mill, and c) both the material bed roll mill and the autogenous mill.

9. The method of claim 8 wherein the remaining fraction of the comminuted material drawn off at the material bed roll mill comprises final product.

10. The method of claim 9 wherein the final product is selectively delivered to a further stage for additional processing.

11. The method of claim 8 wherein the remaining fraction of the comminuted material drawn off at the material bed roll mill is ground to predetermined fineness at a subsequent grinding stage.

12. The method of claim 11 wherein prior to the remaining fraction of the comminuted material being ground at the fine grinding stage, such fraction is delivered to a further classifier where a fine fraction of the material is drawn off as final product and a remaining oversize fraction is delivered to the final grinding stage where finely ground product from the fine grinding stage is returned to the further classifier.

13. The method of claim 1 wherein the fresh ore material fed to the autogenous mill is first pre-crushed in a primary crusher.

14. A method of comminuting fresh ore material containing constituents which characteristically hinder material bed comminution of such material, said method comprising the steps of:

pre-comminuting the fresh ore material in an autogenous mill;

separating the pre-comminuted fresh ore material into a relatively coarser fraction and a relatively finer fraction containing at least most of said constituents;

delivering the relatively coarser fraction of the pre-comminuted fresh ore material to a material bed roll mill and further comminuting such material in a grinding gap between two rolls of the roll mill; and separating the further comminuted fresh ore material into relatively fine and relatively coarse fractions.

* * * * *